United States Patent [19]

Barendsz et al.

[11] Patent Number: 4,644,333

[45] Date of Patent: Feb. 17, 1987

[54] GAS SENSOR AND DETECTION SYSTEM COMPRISING SUCH A SENSOR

[75] Inventors: Anton W. Barendsz, Katwijk Aan Zee; Cornelis A. van Beest, Leiderdorp; Robert Leur, Leidschendam, all of Netherlands

[73] Assignee: Statt der Nederlanden (Stattsbedrijf der Rosterijen, Telegrafie en Telefonie), The Hague, Netherlands

[21] Appl. No.: 657,798

[22] Filed: Oct. 4, 1984

[30] Foreign Application Priority Data

Oct. 14, 1983 [NL] Netherlands ..... 8303544

[51] Int. Cl.[4] ..... G08B 17/10

[52] U.S. Cl. ..... 340/634; 73/23

[58] Field of Search ..... 340/632, 633, 634, 661; 73/1 G, 23

[56] References Cited

U.S. PATENT DOCUMENTS

| | | | |
|---|---|---|---|
| 3,801,972 | 4/1974 | Ho Kim et al. | 340/634 X |
| 3,815,114 | 6/1974 | Johnson et al. | 340/633 X |
| 3,851,520 | 12/1974 | Schluter et al. | 73/1 G X |
| 4,250,737 | 2/1981 | Biglin | 73/23 |
| 4,256,985 | 3/1981 | Goodson et al. | 73/23 X |
| 4,443,791 | 4/1984 | Risgin et al. | 340/634 |
| 4,490,715 | 12/1984 | Kusahagi et al. | 340/634 |

FOREIGN PATENT DOCUMENTS 7008421 12/1970 Netherlands .

8001265 3/1980 Netherlands .

OTHER PUBLICATIONS

The Radio and Electronic Engineer, vol. 44, No. 2, Feb. 1974, (London, Great Britain) Watson et al.; "Applications of the Taguchi Gas Sensor to Alarms for Inflammable Gases", pp. 85–91.

*Primary Examiner*—James L. Rowland
*Assistant Examiner*—Daniel Myer
*Attorney, Agent, or Firm*—Frishauf, Holtz, Goodman & Woodward

[57] ABSTRACT

Gas sensor consisting of a housing which is divided into two compartments 3 and 4 by means of a fluid filter 2, e.g. a bed of activated charcoal. Compartment 3 has an inlet channel 5 and contains a first gas-sensitive semiconductor 6, the measuring device. Compartment 4 has an outlet channel 7 and contains a second gas sensitive semiconductor 8, being used as a reference device. The value of the electric resistances of devices 6 and 8 will increase or decrease when the compartments 3 and 4 contain either an oxidizing or a reducing gas. The sensor is used in a gas detection system in which an electronic circuit which follows determines the ratio between said resistances and the ratio of the reference device and a reference resistance. These ratios are subsequently compared to certain limiting values, and when these values are exceeded, a detection signal will be produced.

6 Claims, 4 Drawing Figures

GAS SENSOR AND DETECTION SYSTEM COMPRISING SUCH A SENSOR

BACKGROUND OF THE INVENTION

1. Field of Application

The invention concerns a gas sensor comprising a gas-sensitive semiconductor, as well as a gas detection system using such a sensor.

2. State of the Art

A publication entitled "Figaro Gas Sensor TGS 812" describes several embodiments of a gas-sensitive semiconductor of the TGS (Taguchi Gas-sensing Semiconductor) type as well as a number of possible applications of said semiconductor in a gas detector system. The system is based on the principal that the electric resistance in TGS devices increases in oxidizing gases and decreases in reducing gases. In addition, the electric resistance depends also on the temperature and the relative humidity of the atmosphere in which the TGS device is placed, as well as on variations in voltage $V_h$ or $V_c$, more specifically the voltage that heats the device, or its output voltage. Aiming at a simple and effective elimination of unwanted effects, caused by variations in the ambient temperature and humidity, the device must be adjusted to a working level coinciding with a value taken from a stable part of the temperature and humidity curve. However, this method creates a disadvantage in that the measuring sensitivity of the semiconductor (i.e. the change of resistance as a function of the gas concentration) will be decreased. This means that if a gas detection system employs a single TGS device, which is usual, the requirements for simplicity of structure, chemical reliability, concerning both measuring sensitivity and selectivity, as well as immunity to disturbing variations, can only be met problematically. Moreover, the techniques presently known cannot offer a solution to the problem involved in realizing a detection system with a basically non-selective TGS device, which will be immune to effects caused by chemical compounds normally occurring in the atmosphere.

It is an object of the invention to provide a solution to the problems outlined above. More specifically the aim of the invention is to provide a gas sensor or gas detection system which meets the following combination of requirements:

selective detection with regard to definable groups of gases;

a high measuring sensitivity, which means that the system must be capable of detecting small concentrations of one of the preselected gases;

simplicity of embodiment;

immunity to variations in ambient and operating parameters; and a low cost price.

SUMMARY OF THE INVENTION

The invention is based on the idea that the requirements listed above can be met when use is made of the known principle which says that a filter absorbs certain pertinent gases and allows other non-pertinent gases to pass freely, provided that two TGS devices are placed—one on each side of the filter—in the gas flow which must be monitored. Thus, a gas sensor with a gas-sensitive semi-conductor is, according to the invention, characterised in that the gas-sensitive semiconductor together with a second gas-sensitive semiconductor are mounted in a housing; that this housing is divided into two compartments by a fluid filter, so that the fluid contained in the one compartment can only reach the other compartment by passing through this filter; that the first gas-sensitive semi-conductor and the second gas-sensitive semiconductor are mounted in the one and the other of the two compartments, respectively; and that each of the two compartments communicates with the environment of the sensor by means of a fluid flow opening.

When, for example, the filter contains activated charcoal, highly volatile gases such as $O_2$, $N_2$, $CO_2$, $CH_4$ and CO will be allowed to pass through the filter, whereas pertinent gases such as $Cl_2$, $COCl_2$ (phosgene), ClCN (Chlorine cyanogen), $CHClF_2$ (a halogenated hydrocarbon), $H_2$, $C_2H_2$ (acetylene), HCl and $H_2S$ and all other hydrocarbons will be absorbed.

A gas sensor according to the invention can effectively be incorporated in a gas detection system which is part of a larger installation monitoring shelters with regard to inadmissible concentrations of certain gases which might penetrate into these shelters. Such shelters usually have an individual ventilation system with inlets through which unwanted gases might enter.

A gas-sensitive detection system provided with a gas sensor according to the invention is further characterised in that each of the two gas-sensitive semiconductors is electrically coupled with the signal processing unit in order to receive a first electric signal and a second electric signal which are respectively indicative of the electric resistance of the first and the second gas sensitive semi-conductors; this processing unit has been designed to produce an output signal which is a measure for the ratio or the difference between the two said electric resistances, whereas the said output is electrically connected to an alarm circuit which is designed to produce an alarm signal when said ratio or difference is lower or higher than a first or a second limiting value, respectively.

As gas components such as CO are allowed to pass through the filter, it is advisable to design the detection system so that, with the help of another detection criterion, it is capable of giving a signal when the concentration of such gas components has become inadmissible. For this purpose, the detection system, according to the invention, is further characterised in that it is provided with a second alarm circuit, which is designed to produce a second alarm signal, when an electric signal, indicative of the electric resistance of the gas-sensitive semiconductor, which is placed in the compartment from which the fluid flow is discharged, exceeds a third limiting value.

SHORT DESCRIPTION OF THE DRAWINGS

The invention will be explained with reference to the drawings, in which

REFERENCES

A brochure entitled "Figaro Gas Sensor TGS 812";
R. A. Roos, "TGS the Gas-sensitive Semiconductor"
GB 2,067,764
GB application No. 001988 (21-01-80).

DESCRIPTION OF THE INVENTION

Without being limited to one application, the present invention is chiefly meant to detect quickly (within a couple of seconds) the presence of a preselected gas with a concentration exceeding certain limiting values, which will be specified later.

The table below mentions a number of chemical agents which must activate the detection system in question. It specifies those concentrations which a. must be detected (required on the basis of a 5 minute's action);

b. should preferably be shown as soon as the MAC values are exceeded.

| Chemical agent | | concentration to be shown ($mg/m^3$) | | MAC-value |
|---|---|---|---|---|
| Name | chemical formula | required | desired | ($mg/m^3$) |
| carbon monoxide | CO | $2,4 \cdot 10^5$ | $2 \cdot 10^3$ | 55 |
| chlorine | $Cl_2$ | $1,5 \cdot 10^4$ | 130 | 1.5 |
| phosgene | $COCl_2$ | $1,3 \cdot 10^4$ | 110 | 0.4 |
| hydrocyanic acid | HCN | $8 \cdot 10^3$ | 70 | 11 |
| chlorine cyanogen | ClCN | $5,7 \cdot 10^4$ | 500 | 0.5 |
| halogenated hydrocarbon 22 | $CHClF_2$ | $2,1 \cdot 10^4$ | (1000 ppm) | 1000 ppm |
| hydrogen | $H_2$ | $7,3 \cdot 10^4$ | 600 | |
| acetylene | $C_2H_2$ | $4,8 \cdot 10^5$ | $4 \cdot 10^3$ | |
| hydrochloric acid | HCl | | 100 | 7 |
| hydrogen sulphide | $H_2S$ | | 100 | 15 |

Within the scope of the present invention, a system has been selected to perform the desired security functions with fast-reacting non-selective gas-sensitive semiconductors as e.g. TGS devices.

As a rule, concentrations of exhaust gas emissions (car traffic) which are being sucked in via the inlet of the ventilation system in question are relatively high. The non-selective semiconductors should be prevented from giving an unwanted (false) alarm. In addition, the alarm system must be immune to normal variations in the ambient temperature and humidity.

Figure 1:
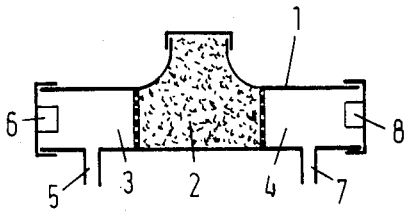
FIG. 1 is a diagram of an embodiment of a gas sensor according to the invention.

On the basis of the aforementioned considerations, a gas sensor has been designed according to the schematic view shown in FIG. 1. Use has been made of the knowledge that highly volatile gases such as $O_2$, $N_2$, $CO_2$, $CH_4$ and CO are allowed to flow almost freely through a filter with activated charcoal. This group of gases also includes those gases ($CO_2$, $CH_4$ and CO) which form the main components of the exhaust gases mentioned earlier.

The sensor shown in FIG. 1 comprises a substantially cylindric housing 1 made of a non-absorbing material. The housing may take the form of a glass or stainless steel tube with a given diameter. A bed of activated charcoal 2 divides the interior of the housing into an inlet compartment 3 and an outlet compartment 4. The activated charcoal bed is located by two (not shown) perforated glass partitions or stainless steel gauze partitions fitted inside the housing. A first gas-sensitive semiconductor 6, functioning as a measuring device (TGS device) has been incorporated in the inlet compartment which communicates with the ambient atmosphere by means of an inlet channel 5. In the same way, a second gas-sensitive semiconductor 8, functioning as a reference device (TGS device), has been fitted in the outlet compartment 4, which communicates with the ambient atmosphere by means of an outlet channel 7. Although it is not required, it may be advantageous to use 2 TGS devices with substantially the same physical properties. Each of the TGS devices has a gastight fitting in the appropriate extremity of the housing.

It may be advisable to maintain the amount of air flowing via the inlet channel 5, the charcoal bed 2 and the outlet channel 7 at a substantially constant value. The value of the electric resistance of a TGS device will increase when the device is placed in an atmosphere of oxidising gas and decrease in an atmosphere of reducing gas.

The signal processing circuit (FIG. 2), to be described hereafter has been designed to fulfill the desired detection or alarm functions on the basis of the following relations $$G = V_M / V_R$$

and $$H = V_R / V_{RO}$$

which can be defined as follows:

$V_M = K_M / R_M$ in which $K_M$ represents a first constant and $R_M$ the electric resistance of the measuring device.

$V_R = K_R / R_R$ in which $K_R$ represents a second constant and $R_R$ the electric resistance of the reference device; and $V_{RO}$ represents the value of $V_R$, when the system is adjusted to the required supply voltage, e.g. after one week, and G will be adjusted to 1 (a description of the adjustments will be given later).

Allowing for variations of $V_M$ and $V_R$ resulting from variations in ambient atmosphere (e.g. exhaust gases of car traffic and relative humidity) which can be expected normally, experimental test have shown that the atmosphere inside a monitored shelter can be regarded as normal or "safe" if $0.5 < G < 2.0$ and/or $H < 4$. Obviously these limits have only exemplary value.

Although TGS devices are sensitive to changes in relative humidity of the ambient atmosphere, complete immunity to slowly-developing variations exists on account of the "device-filter-device" structure of the gas sensor according to the invention. Moreover, temperature variations covering a range between −15° and +55° C. apparently have no significant influence on the electric resistance of the TGS devices normally heated by electric current.

Figure 2:
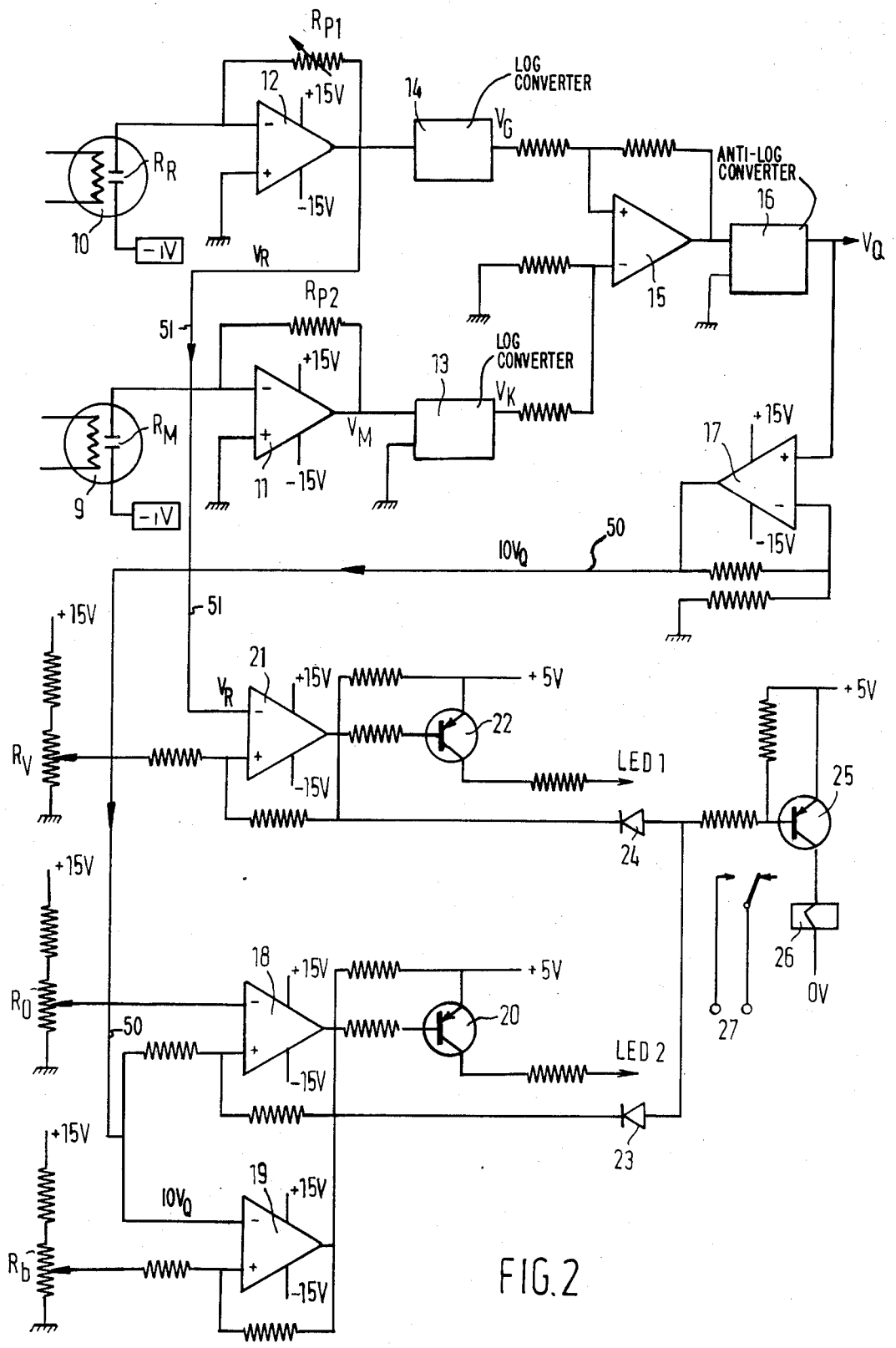
FIG. 2 is a diagram of an embodiment of a detection alarm system which is designed to be used in combination with a gas sensor according to the invention.

FIG. 2 is a diagram of an embodiment of a circuit with a detection and an alarm function, in which electric signals delivered by the measuring device and the reference device of a gas sensor according to the invention are processed. The invention is obviously not limited to this embodiment.

Figure 3:
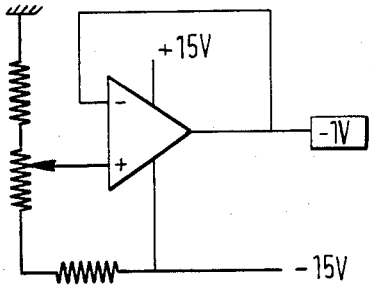
FIG. 3 is a diagram of a supply circuit for a d.c. stabilized voltage.

The electric resistances $R_M$ and $R_R$ of the TGS measuring device 9 and the TGS reference device 10, respectively are on the one hand connected to the inverting input of a corresponding operational amplifier 11 or 12, and on the other hand they are connected to a stabilized d.c. voltage supply of e.g. −1 V. This stabilized voltage can be simply obtained by means of a fed-back operational amplifier, see the diagrammatic representation of FIG. 3.

The adjustment referred to above requires the output voltages $V_M$ and $V_R$ of the operational amplifiers 11 and 12, respectively, to be adjusted to a value of 100 mV by means of the feed-back resistors $R_{p2}$ and $R_{p1}$, respectively, when a flow of "clean" air is led past the two units 9 and 10. The following relations apply:

$$V_M = \frac{-R_{p2}}{R_M} \cdot (-1) = \frac{R_{p2}}{R_M}$$

$$V_R = \frac{-R_{p1}}{R_R} \cdot (-1) = \frac{R_{p1}}{R_R}$$

The outputs of the operational amplifiers 11 and 12 are connected to the inputs of log converting circuits 13 and 14, respectively. The generated output voltages $V_K$ and $V_G$ of these circuits are stated as: $V_K = -\log(V_{M/10} - 1)$ and $V_G = -\log(V_{R/10} - 1)$, respectively.

Both outputs of circuits 13 and 14 are connected to the input of a differential amplifier 15. The output signal $V_P$ of this amplifier 15 is given as:

$$V_P = \log(V_R/V_M).$$

This output signal is fed into the input of an anti-log converting circuit 16 with an output signal $V_Q$ given as $V_Q = 10^{-1}.10^{-\log(VR/VM)}$. From the above it can be derived that when the adjustment of $V_R = V_M = 0.1$ V has been effected, $V_Q = [(V_R/V_m)0.10]^{-1} = 0.1$ V will apply. If the relation $G = V_M/V_R = 1$, then $V_Q = 100$ mV.

The signals $V_R$ *and* $_{RQ}$ generated in the previously-described detection part, which is shown in the upper part of FIG. 2, are the input magnitudes for the alarm part to be described hereafter, which is shown in the lower part of FIG. 2. Based on the criteria outlined above, an alarm signal must be generated if $G < 0.5$ or $G > 2$ and/or $H > 4$.

For the sake of simplicity, the first alarm criterion is developed by comparing $10 \cdot V_Q$ with the adjusted alarm threshold value of 0.5 V and 2 V, respectively. For this reason, the output of circuit 16 has been connected to the input of a differential amplifier 17, which amplifier delivers the output signal of $10 \cdot V_Q$ to the connection line 50. The alarm part also uses a minimum peak differential amplifier 18 and a maximum peak differential amplifier 19. The amplifiers 18 and 19 will compare the voltage $10 \cdot V_Q$ with the minimum peak, being 0.5 V adjusted by means of a voltage divider $R_O$, and the maximum peak, being 2 V, adjusted by means of a voltage divider $R_b$, respectively. If the first alarm criterion is met, a common output transistor 20 will become conductive, activating an alarm device, e.g. a light emitting diode LED 2.

Another differential amplifier 21 will compare voltage $V_R$ supplied by the line 51 with a threshold value of 0.4 V adjusted by means of a voltage divider $R_V$. As soon as the alarm criterion $H > 4$ is met, the output transistor 22 will become conductive, activating a separate alarm device e.g. a light emitting diode (LED 1).

In the embodiment as represented, the outputs of the amplifiers 18, 19 and 21 are connected to a control transistor 25 for a switching relay 26 via the corresponding diodes 23 and 24, respectively, so that as a result of an alarm, switching can take place in the remotely-located circuit 27.

Figure 4:
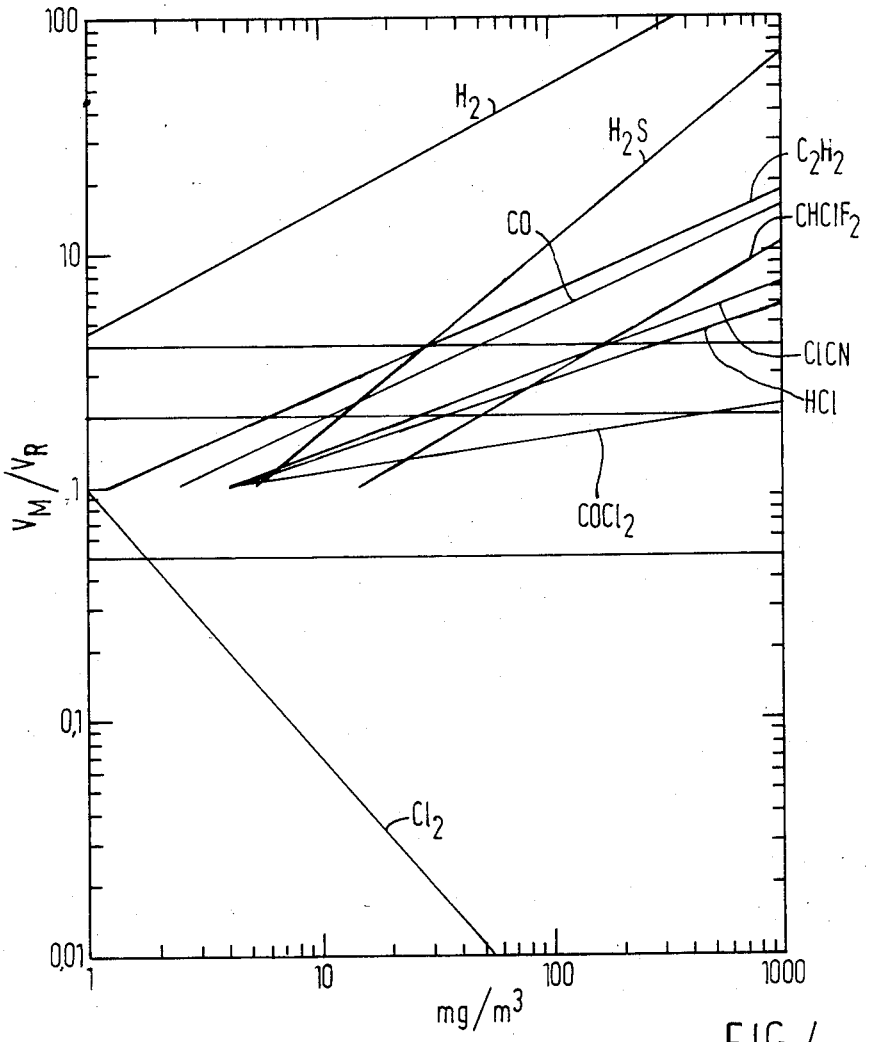
FIG. 4 is a diagram illustrating system responses to various chemical agents which can be detected with a system of the type shown in FIG. 2.

FIG. 4 is an example of the system responses to various agents. The gas concentration has been plotted on the abscissa in (mg/m$^3$). The relation $V_M/V_R$ has been plotted on the ordinate, with $V_R$ representing the voltage at the output of amplifier 12 provided that $V_R = 1$ V.

The invention allows reliable detection of very small concentrations of gas with a certain degree of selectivity and is, consequently, not limited to the embodiment and applications cited.

We claim:

1. Apparatus for monitoring a gas flow containing sensor-affecting components for determining the content of target gas components among said sensor-affecting components of said gas flow, comprising:

first semi-conductor gas sensing means located in a first chamber for obtaining a first signal indicative of the response of said gas sensing means to all of the sensor-affecting components contained in a gas flow passing through said first chamber;

filter means connected to said first chamber for receiving said gas flow sensed by said first semi-conductor gas sensing means and including absorption means for absorbing the full amount of target gas components among said sensor-affecting components contained in said gas flow while passing the full amount of non-target gas components contained in said gas flow, and second semi-conductor gas sensing means disposed in a second chamber for receiving directly from said filter means said gas flow passed by said filter means, for producing a second signal indicative of sensor response to non-target sensor-affecting gas components contained in the gas flow received from said filter means, said first and second semi-conductor gas sensing means being sufficiently similar for enabling comparative processing of said first and second signals for determining the content of target gas components in the monitored gas flow as sensed by said first semi-conductor sensing means.

2. Apparatus according to claim 1, wherein said absorption means includes a bed of activated charcoal.

3. Apparatus according to claim 1 wherein both said first sensing means and said second sensing means are semi-conductor devices of which the electric resistance increases in oxidizing gases and decrases in reducing gases.

4. Apparatus according to claim 1, wherein both said first and second semi-conductor gas sensing means respond to both target and non-target sensor-affecting components by showing a change in the electric resistance of the sensing means and wherein comparative processing means for said first and second signals are provided which include a signal processing unit having a first input for receiving a first electric signal indicative of the electric resistance value of said first semi-conductor gas sensing means and a second input for receiving a second electric signal indicative of the electric resistance value of said second semi-conductor gas sensing means, said signal processing unit being consitutued to provide a third electric signal representative of the ratio of the values respectively of said first and second electric signals and for comparing said third electric signal with first and second constant reference signals of predetermined values and for activating thereby a first output signal when said third electric signal has a value higher than said first reference signal and a second output signal when said third electric signal has a lower value than said second reference signal.

5. Apparatus according to claim 4, wherein said comparative processing means for said first and second signals further includes additional signal processing means responsive to said second electric signal, received at the input of said additional signal processing means, for comparing said second electric signal with a third constant reference signal of predetermined value and for activating a third output when said second electric signal has a higher value than said third reference signal.

6. Apparatus according to claim 4, wherein both said first sensing means and said second sensing means are semi-conductor devices of which the electric resistance increases in oxidizing gases and decreases in reducing gases.

* * * * *